US012188752B2

(12) United States Patent
Baps et al.

(10) Patent No.: US 12,188,752 B2
(45) Date of Patent: Jan. 7, 2025

(54) LOCKABLE AMMUNITION

(71) Applicant: FN HERSTAL S.A., Herstal (BE)

(72) Inventors: Bernard Baps, Couthuin (BE); Damien Verhaegen, Thimister (BE); Romain Santus, Antheit (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 18/263,838

(22) PCT Filed: Feb. 10, 2022

(86) PCT No.: PCT/EP2022/053199

§ 371 (c)(1),
(2) Date: Aug. 1, 2023

(87) PCT Pub. No.: WO2022/171720

PCT Pub. Date: Aug. 18, 2022

(65) Prior Publication Data

US 2024/0102776 A1 Mar. 28, 2024

(30) Foreign Application Priority Data

Feb. 10, 2021 (EP) ..... 21156324

(51) Int. Cl.

| | |
|---|---|
| ***F42B 5/26*** | (2006.01) |
| ***F41A 21/06*** | (2006.01) |
| ***F41A 21/12*** | (2006.01) |
| ***F42B 5/08*** | (2006.01) |

(52) U.S. Cl.

CPC ..... *F42B 5/26* (2013.01); *F41A 21/06* (2013.01); *F41A 21/12* (2013.01); *F42B 5/08* (2013.01)

(58) Field of Classification Search

CPC ..... F41C 3/00; F41C 3/14; F41A 9/27; F41A 9/28

USPC ..... 42/59–61, 65

See application file for complete search history.

(56) References Cited

U.S. PATENT DOCUMENTS 6,357,157 B1 * 3/2002 Constant ..... F41A 19/58 42/84

FOREIGN PATENT DOCUMENTS

| | | | |
|---|---|---|---|
| DE | 3044452 | A1 | 6/1982 |
| DE | 102019106357 | A1 | 9/2020 |
| FR | 1605300 | A | 8/1974 |

OTHER PUBLICATIONS

International Search Report and Written Opinion of the International Searching Authority from the European Patent Office, in PCT/EP2022/053199 dated May 10, 2022, which is an international application corresponding to this U.S. application.

* cited by examiner

*Primary Examiner* — Reginald S Tillman, Jr.
(74) *Attorney, Agent, or Firm* — Kolitch Romano Dascenzo Gates LLC

(57) ABSTRACT

The present disclosure relates to an ammunition intended for cooperating with a barrel including a first fastening element. The ammunition has a cartridge case housing a projectile and an electrically primed primer for projecting the projectile during use. The cartridge case has a second fastening element to lock the ammunition in the barrel onto the first fastening element.

18 Claims, 5 Drawing Sheets

LOCKABLE AMMUNITION

TECHNICAL FIELD

The present disclosure relates to the field of firearms, in particular so-called "less lethal" launchers, and more particularly to the field of appropriate ammunition and magazines, suitable for such type of launcher.

The disclosure relates more specifically to a simplification of weapons compatible with low-power ammunition, in order to avoid therein as many movable parts as possible.

BACKGROUND

As is known to a person skilled in the art, a typical ammunition consists of a cartridge case housing a projectile (such as e.g. a bullet) and a pyrotechnic charge, as well as a primer for igniting the propellant. The propellant, located behind the bullet, is ignited, creating a combustion reaction, the gases generated of which project the bullet out of the barrel.

In the well-known case of the revolver, the weapon comprises a barrel wherein chambers are hollowed, for containing the individual ammunition. The chambers are brought in turn by rotation in front of an independent barrel, thus allowing a plurality of shots to be fired successively. The mechanical operation of the revolver induces a certain number of movements of movable parts. Indeed, when the trigger is pressed, a lever pushes the hammer back, which compresses a spring in the butt. At the same moment, another lever pushes a notch at the back of the cylinder which rotates the cylinder by a fraction of a turn so as to place the next chamber in front of the barrel and which, at the end of the movement, engages the lock of the cylinder, providing a precise alignment with the barrel. The trigger at the end of the stroke then releases the hammer, the spring relaxes and pushes the hammer forward until the firing pin meets the primer of the ammunition.

The revolver thus has the advantage of being a handgun with a magazine (cylinder in the present case) which can comprise a plurality of ammunitions, for firing a plurality of shots before having to reload. However, the classic revolver requires the use of a plurality of movable parts, fully actuated by the finger of the shooter on the trigger. The sequence of movements of the different movable parts can be uncomfortable and represent a potentially troublesome firing delay.

On the other hand, in semi-automatic pistols, the impulse generated by firing during a shooting allows the movable parts to return to the initial positions thereof in order to re-arm the weapon. Such mechanism is complex, expensive and likely to jam. Furthermore, in the context of ammunition for "less lethal" weapons, the charge can be too low to initiate the movement of the movable parts, which would hinder the correct rearming of the weapon.

SUMMARY

The present disclosure aims to overcome the drawbacks of the prior art. The present disclosure aims, more particularly, at providing a weapon including the fewest movable parts, leading to essentially electrical operation.

One of the goals of the present disclosure is thus to simplify as much as possible the design of the weapon, in order to further simplify the manufacture and the maintenance thereof.

Another goal is to have a magazine which acts as a barrel, the magazine actually having the function of a barrel, leading to a more compact weapon. The charger can further provide the possibility of shooting a plurality of shots successively without having to reload the weapon.

The present disclosure can be further used for avoiding having a combustion chamber in the launcher, the combustion chamber being part of the cartridge case, which allows the magazine to be used with any type of device for activating the primer. More precisely, the above can be achieved by a launcher with a handgun design, but also a launcher with a simple straight handle, similar e.g. to a flashlight handle.

Another goal of the present disclosure is to provide a launcher with a removable magazine, which can be separated from the gripping part of the launcher. The ammunition can thus be loaded beforehand into the magazine, before placing the magazine on the gripping part of the launcher.

Another goal is to make possible a manual locking of the ammunition in the barrel, thus avoiding having an insertion mechanism in the chamber.

Moreover, the present disclosure is more particularly suitable for so called less lethal launchers.

The present disclosure discloses an ammunition, intended for cooperating with a barrel comprising a first fastening element, the ammunition comprising a cartridge case housing a projectile and an electrically primed primer, said cartridge case comprising a second fastening element configured to lock, during use, said ammunition in said barrel on the first fastening element.

The present disclosure includes at least one or a suitable combination of the following features:

- the electrically ignited primer comprises a resistive bridge with low resistance before use and with high resistance after use;
- the ammunition comprises a pyrotechnic charge producing, during use, a kinetic energy of the projectile divided by the impact surface area of less than 100 Joules/cm$^2$, preferentially less than 50 J/cm$^2$, typically on the order of 30/cm$^2$;
- the ammunition comprises a pyrotechnic charge producing a kinetic energy of projection divided by the impact surface area of at least 7 J/cm$^2$, preferentially at least 15 J/cm$^2$.
- The ammunition comprises only one primary charge (i.e. no secondary charge, more specifically, the ammunition comprises a primer but no propelling charge).

A second aspect of the present disclosure relates to a barrel intended for cooperating with the electrically primed ammunition, comprising a first fastening element for locking, during use, the ammunition inside the barrel by cooperation between the first fastening element and the second fastening element. The locking of the ammunition in the barrel is preferentially a bayonet connection.

Advantageously, the barrel is preloaded by the ammunition. The locking of the ammunition in the barrel is preferentially a bayonet connection.

Preferentially, the first fastening element of the barrel is female and the second fastening element of the cartridge case is male.

Preferentially, the cartridge case of the ammunition protrudes from the barrel and is only partially jacketed by the barrel.

A third aspect of the present disclosure relates to a magazine assembly comprising a plurality of barrels according to the present disclosure, each barrel being used for loading an ammunition, the ammunition being lockable inside the barrel using the first fastening element and the second fastening element.

Advantageously, the magazine assembly comprises five barrels for loading and unloading of five pieces of ammunition.

A fourth aspect of the present disclosure relates to a launcher comprising a removable magazine assembly which can be separated from the weapon.

Preferentially, the launcher comprises a gripping part with holes for receiving, during use, the cartridge case sticking out from the magazine when the magazine is inserted onto the gripping part.

Preferentially, the cartridge case part being situated in one of the holes when the magazine is inserted onto the gripping part, is not held by the hole, a clearance comprised between 0.3 and 5 mm being provided between the cartridge case and the hole, preferentially comprised between 0.8 and 3 mm, particularly preferentially equal to 1 mm.

Advantageously, the launcher of the present disclosure is a less lethal launcher.

NUMERICAL REFERENCES OF THE FIGURES

Figure 1:
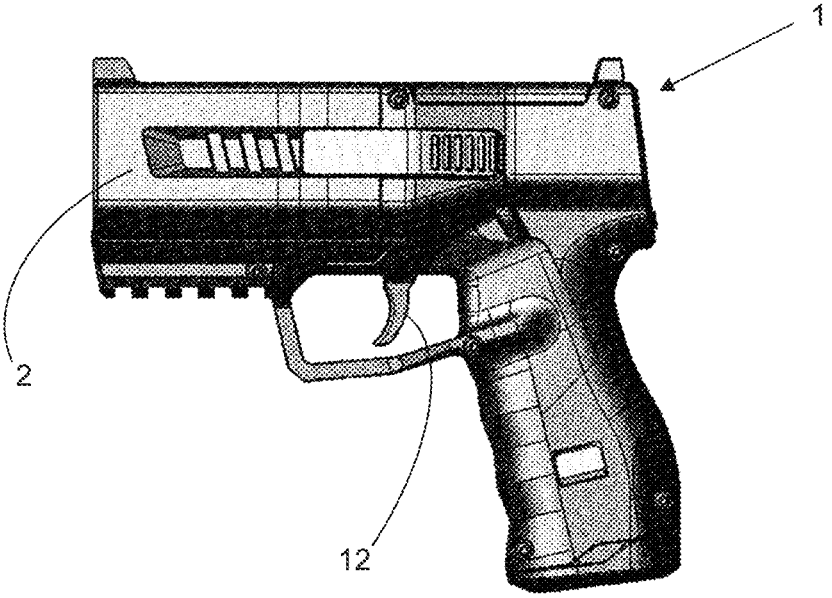
FIG. 1 is a three-dimensional view of an example of a launcher according to the present disclosure, comprising the magazine.

1: launcher
2: charger
3: barrel
4: ammunition
5: cartridge case
6: gripping part of the launcher
7: primer
8: projectile
9: combustion chamber
10: male fastening element (locking stud)
11: female fastening element (locking slot)
12: trigger
13: orifice in the launcher

DETAILED DESCRIPTION

The present disclosure discloses a launcher 1 wherein the number of so-called "movable" parts has been considerably reduced. The launcher of the present disclosure is shown in general lines in FIGS. 1 and 2, in the form of a handgun. Nevertheless, the design can be totally different, as explained hereinbelow in more detail.

By "less lethal weapon", we mean launchers with reduced probability of causing serious injuries. Less lethality can be obtained by the use of particular projectiles with a low penetration (plastic projectile, rubber, breakable envelope comprising shot disintegrating on impact, etc.) and/or reduced density of kinetic energy (i.e. the kinetic energy divided by the impact surface area is less than 100 joules/$cm^2$, preferentially less than 50 joules/$cm^2$, typically on the order of 30 joules/$cm^2$). Such projectiles can nevertheless be disabling, causing pain and/or a recoil effect sufficient for deterring an aggressor from continuing their action. The projectiles can also be used, in the case of certain projectiles, for "marking" the target by means of easy to identify dyes.

Figure 2:
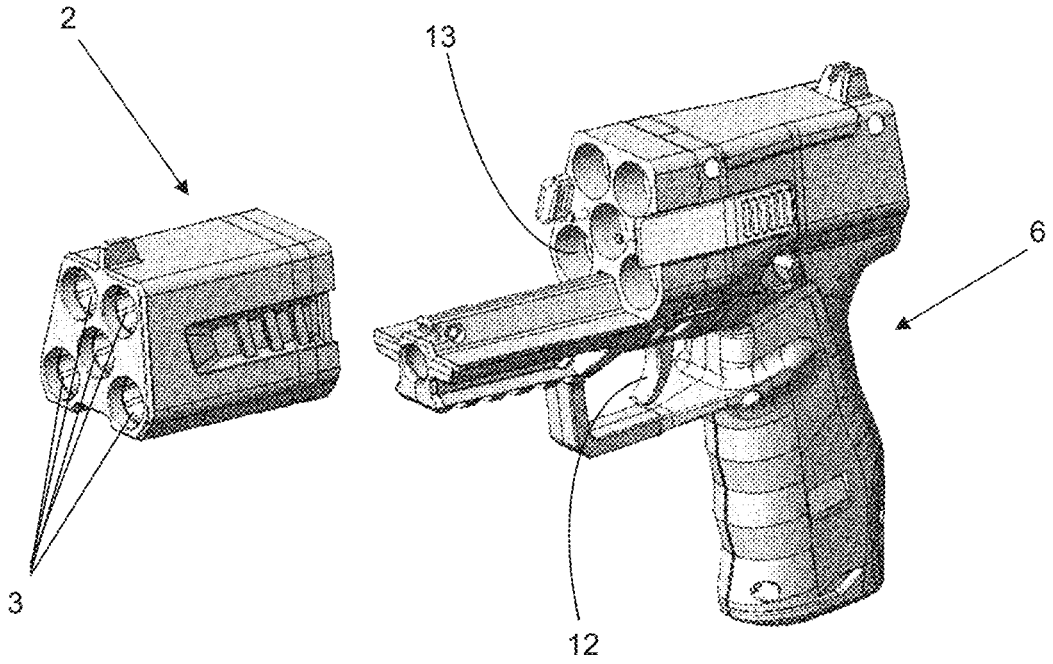
FIG. 2 is a three-dimensional view of an example of a launcher according to the present disclosure, with the magazine disconnected from the launcher.
Figure 3:
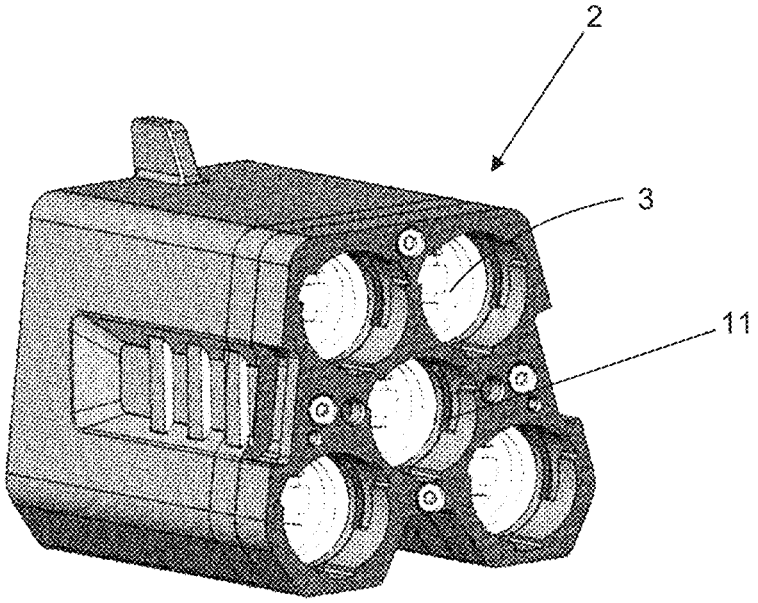
FIG. 3 is a three-dimensional view of an example of a magazine according to the present disclosure, comprising five barrels.
Figure 4:
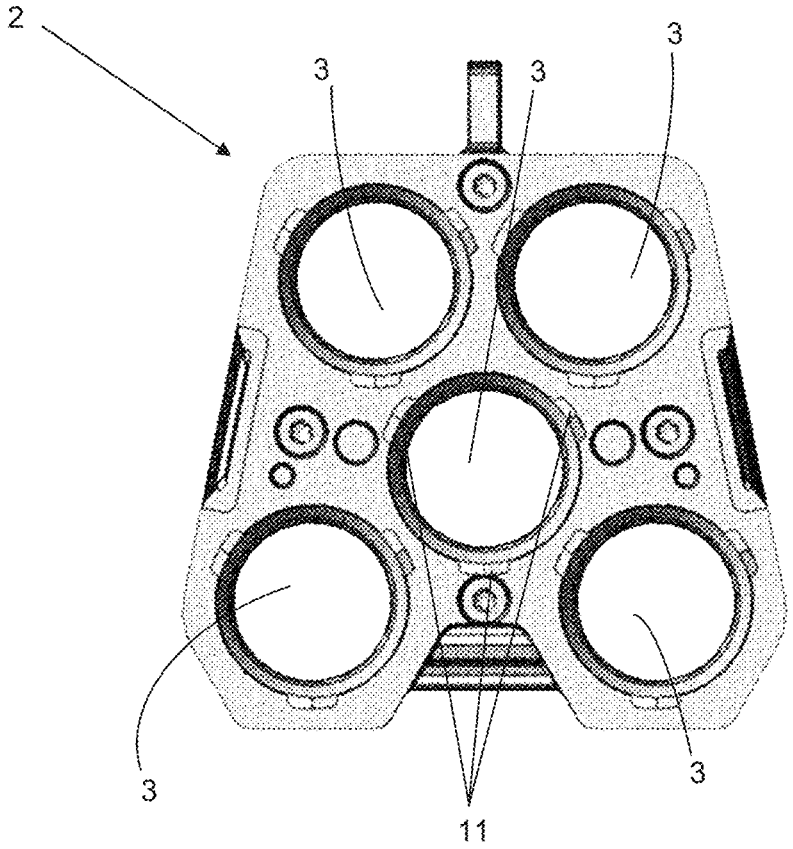
FIG. 4 is an enlarged view of the magazine shown in FIG. 3, the magazine being empty.

As shown in FIG. 1, the launcher 1 comprises a magazine 2. The magazine 2 is removable and can thus be detached from a gripping part 6 of the launcher 1 as shown in FIG. 2. The magazine 2 has the specificity of also serving as a barrel. Indeed, as illustrated in FIGS. 3 and 4, the magazine 2 comprises cylindrical holes 3 acting as barrels. The pieces of ammunition 4 are thus loaded beforehand into the different barrels 3, before placing the magazine assembly 2 on the launcher 1. The barrels can be simple bores in the magazine, or comprise an internal jacketing acting as a barrel, e.g. in the case of a plastic magazine comprising a metal jacketing. The charger can also be molded in one piece.

The magazine assembly 2, once separated from the launcher 1, is inoperative. Indeed, the magazine 2 has to be fastened onto the gripping part 6 of the launcher 1, namely the "active" part being configured to provide the priming energy (electric current) to the ammunition 4 present in the barrel 3. The gripping part 6 can have very different designs. Same is represented herein in the form of a handgun with a butt, a trigger 12 and the entire device for triggering the firing in order to transmit the priming energy at the appropriate moment. The gripping part can however have a different design, with a straight handle like the handle of a flashlight. Indeed, in the case of the present disclosure, the launcher 1 should no longer comprise a combustion chamber 9 because the latter is part of the cartridge case 5 and ammunition 4 assembly as such. Such aspect imparts great freedom with regard to the type of launcher 1. In fact, the gripping part 6 should comprise only the device for triggering the firing, making it possible to transmit the ignition energy at the appropriate moment.

The figures show a magazine 2 with five barrels 3, but there could be a different number of barrels. It is also possible to have a magazine 2 with a single barrel 3. The fact of having a removable magazine 2 makes it possible to interchange the type of magazine 2 (with the advantage of having a caliber of ammunition which can vary from one magazine to another, the electrical contacts on the magazine 2 being situated at the same places in order to be compatible with the gripping part 6). Each barrel 3 can be loaded and unloaded multiple times.

Given that the magazine assembly 2 acts as a barrel 3, the launcher is more compact, namely shorter since the ammunition 4 is already inserted in the barrel 3. The weapon of the present disclosure does not comprise a barrel and a magazine, but rather a magazine acting as a barrel, the barrel 3 being thus completely integrated into the removable magazine 2. As will be explained in greater detail hereinbelow, the barrels 3 comprise locking elements 11.

Figure 5:
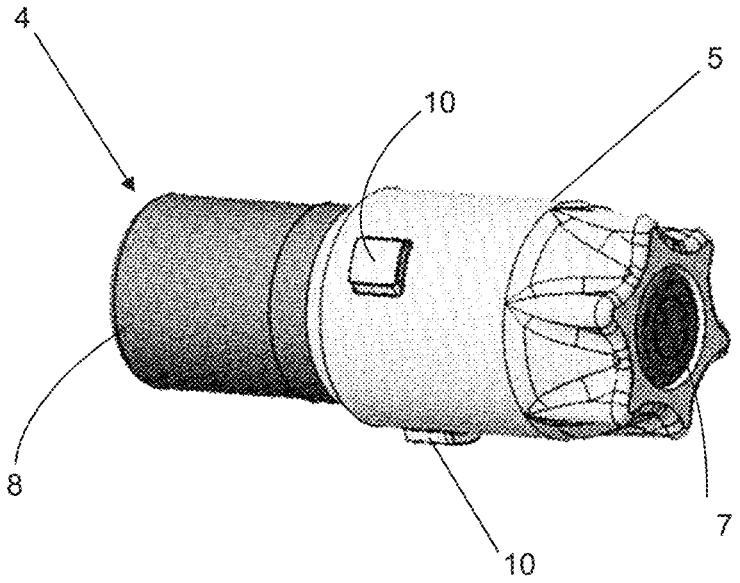
FIG. 5 is a three-dimensional view of an example of ammunition according to the present disclosure.
Figure 6:
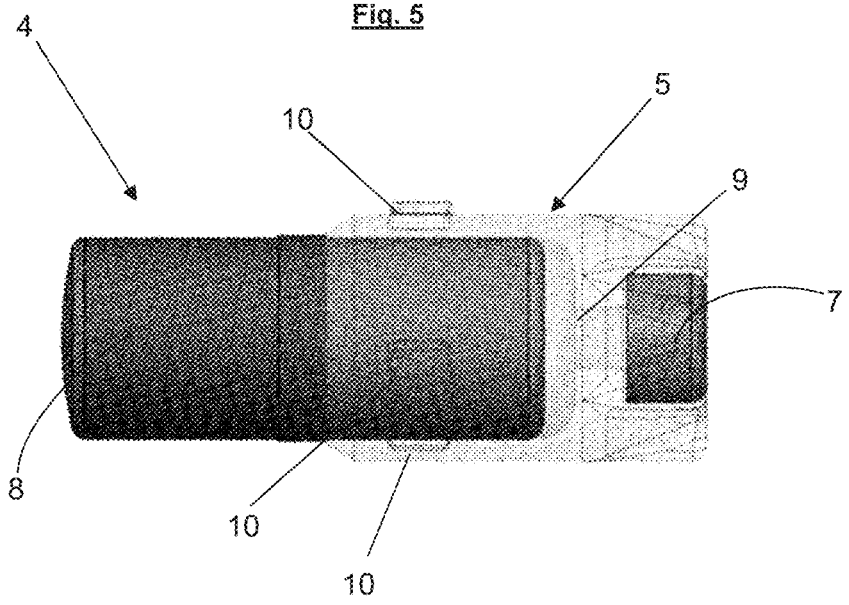
FIG. 6 is another enlarged view of the ammunition shown in FIG. 5.
Figure 7:
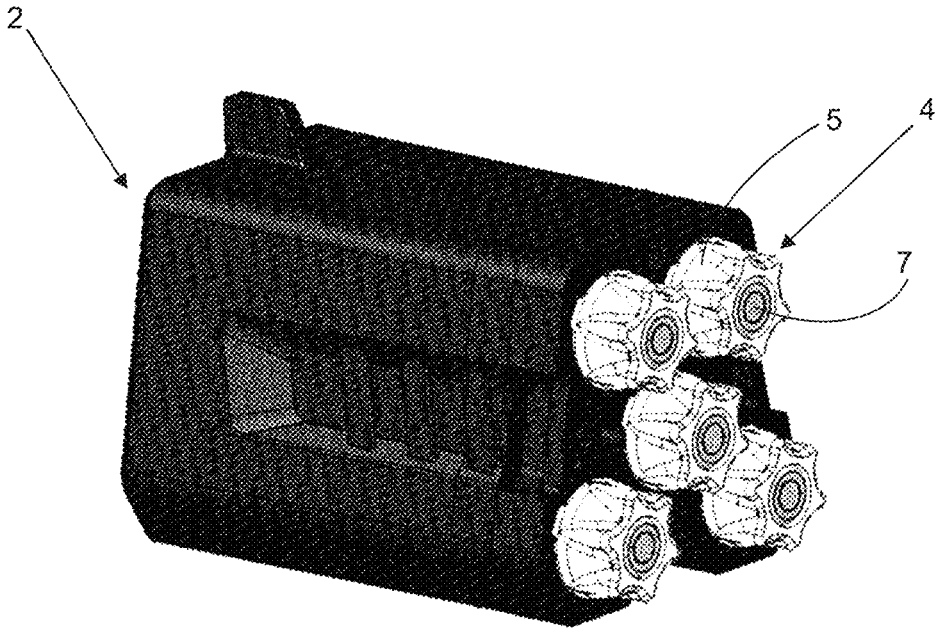
FIG. 7 is a three-dimensional view of the magazine shown in FIGS. 3 and 4, the latter being loaded with five pieces of ammunition.
Figure 8:
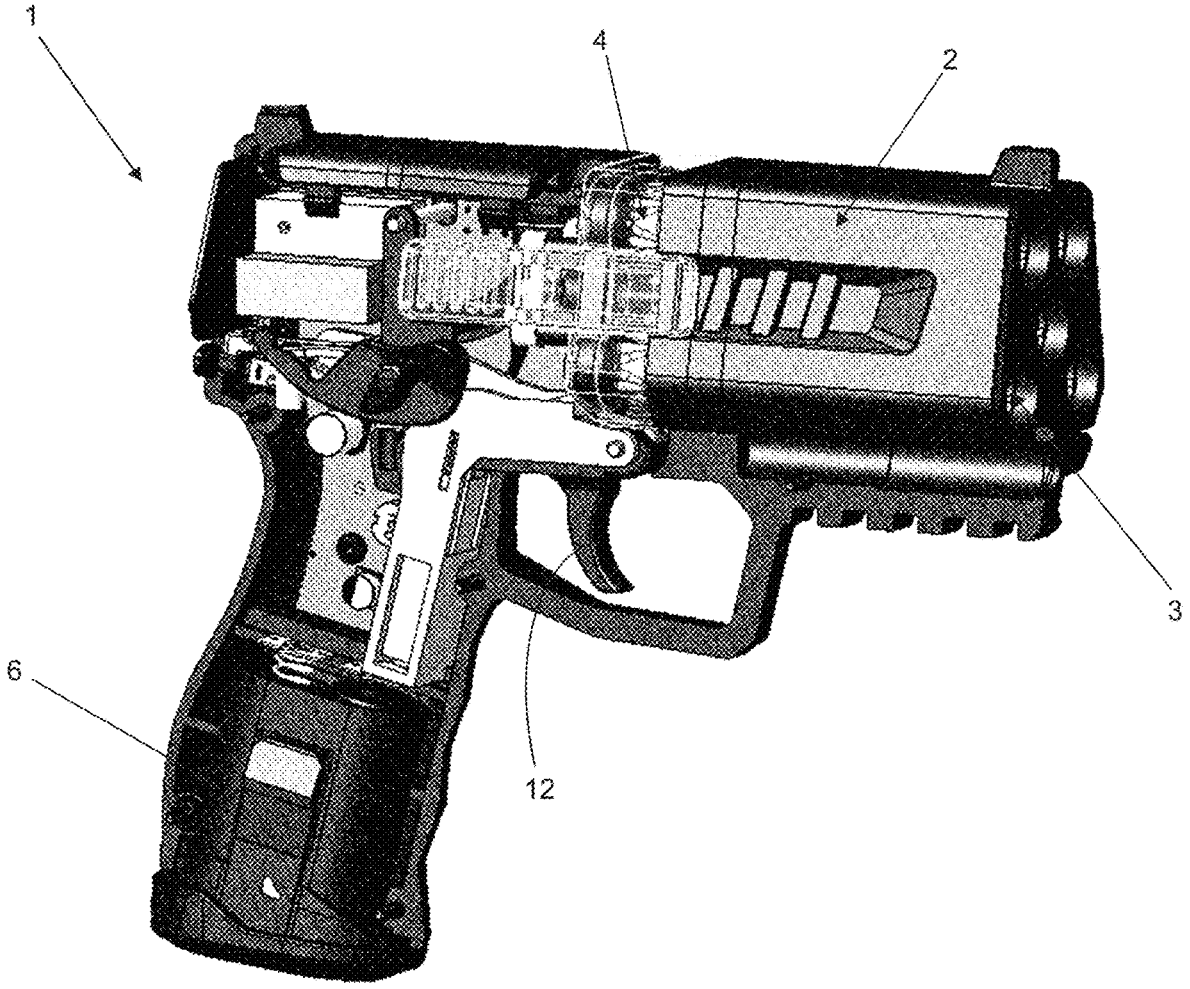
FIG. 8 is a section view of an example of launcher according to the present disclosure.

The present disclosure further relates to ammunition 4, having the specificity of having a plurality of functions. Indeed, the purpose of each piece of ammunition 4 is to carry the projectile 8, but also to lock same inside the barrel 3. Moreover, such ammunition further has the particularity of comprising an electric primer as described e.g. in the patent document U.S. Pat. No. 10,415,944. As shown in FIGS. 5 and 6, the ammunition 4 of the present disclosure comprises a cartridge case 5 housing a projectile 8 and a primer 7 comprising a primary charge, and, if appropriate, a secondary charge, enabling the projectile 8 to be projected out of the barrel 3 of the launcher 1 during shooting. The ammunition 1 further comprises a combustion chamber 9 being comprised inside the cartridge case 5, having the particularity that, when the ammunition 4 is inserted into the barrel 3, the cartridge case 5 and more particularly the part of the cartridge case comprising the combustion chamber 9 is only partially jacketed by the barrel 3. The cartridge case 5 protrudes from the barrel 3 and thus from the magazine 2. Holes 13 are provided in the gripping part 6 of the launcher 1 (see FIG. 2) in order to receive the parts of the cartridge case 5 sticking out from the barrel 3 when the magazine 2 is inserted onto the gripping part 6. However, the parts of the cartridge cases 5 being situated in the holes 13 when the magazine 2 is inserted onto the gripping part 6, are not held by the holes 13. There is a clearance of approximately 1 mm between the cartridge case 5 and the hole 13, which means that the cartridge case 5 is not jacketed by the gripping part 6 of the launcher 1. In this way, there is no combustion chamber present in the gripping part 6 of the launcher 1. It is the cartridge case 5 and ammunition 4 assembly as such which comprises the combustion chamber 9, the cartridge case 5 thus being only partially jacketed by the barrel 3. The gripping part 6 of the launcher 1 is thus not subject to any force during the shooting.

The cartridge case 5 comprises, on the external surface thereof, fastening element 10 for locking the ammunition 4 inside the barrel 3, the latter comprising fastening element 11 cooperating with the fastening element of the cartridge case 5. Indeed, as shown in FIGS. 3 and 4, each barrel 3 comprises first fastening element 11 for cooperating with the second fastening element 10 comprised on the cartridge case 5 of the ammunition 4.

The fastening of the ammunition 4 inside the barrel 3 is preferentially a bayonet connection, namely a connection made by a "push-turn" movement, via studs 10 penetrating into an L-shaped slot/recess 11. The figures show such type of fastening element, for which the first fastening element 11 are thus female fastening element, and the second fastening element 10 are male fastening element. Obviously, any type of suitable fastening can be used. For example, screwing is conceivable. Also, a groove can be made in the ammunition 4, and a spring [can be provided] in the barrel 3, so that the ammunition 4 is clipped by means of the groove inside the barrel 3, pushing the spring. The ammunition of the present disclosure is thus not smooth due to the presence of the fastening elements 10. The cartridge case is preferentially made of plastic, with the projectile made of polymer.

Locking of the ammunition 4 in each barrel 3 is done manually. In this way, the extraction of the cartridge case 5 after the shooting is facilitated. The ammunition 4 lockable inside the barrel 3 simplifies the mechanism of the semi-automatic launcher, since there is no need for a mechanism of insertion into the barrel 3. Indeed, given that the magazine 2 acts as a barrel 3, the ammunition 4 is locked manually directly inside the barrel 3. The cartridge case 5 of the ammunition 4 has a geometry such that same sticks out from the barrel 3 when same is inserted and locked therein. In this way, it is easier for the user to grip the ammunition 4.

The magazine 2 with a plurality of barrels 3 has the advantage of semi-automatic launchers. Moreover, since the magazine 2 is removable, the user can have a stock of magazines in their pocket, with the ammunition 4 already placed in the magazine 2. The locking principle for the ammunition 4 is used for preparing the loading in advance without any risk of losing the ammunition 4.

In order to reduce the use of movable parts, the launcher 1 of the present disclosure preferentially has a 100% electrical use, with the exception of the firing trigger mechanism.

Since the bores in the magazine 2 act as a barrel 3, the magazine 2 should not rotate like in the revolver (where, in the present case, the bores in the cylinder should be placed in turn in front of the barrel of the launcher). Thus, starting from the principle that the magazine 2 comprises a plurality of barrels 3, each barrel 3 comprising the ammunition 4 will be used in turn during firing.

In addition, the launcher includes a device configured for performing the steps of a safety process:

- measuring an electrical quantity of the electrical circuit for firing the ammunition;
- deactivating the fire control (or alert the user by means of a signal, in particular an audible, a vibratory and/or a visible signal) when the detected quantity is outside a predefined range of values.

More particularly, the electrical element for priming the ammunition has a low heat resistance so that the ignition of the primary charge destroys same. In this way, the detection of infinite resistance on the priming circuit makes it possible to determine that the loaded ammunition has already been used and needs to be replaced. Such feature is particularly useful in the case of multiple pieces of ammunition placed in a circuit provided for a sequential ignition of different cartridges loaded simultaneously.

The invention claimed is:

1. An ammunition, configured to cooperate with a barrel comprising a first fastening element, the ammunition comprising:

- a cartridge case housing a projectile, a combustion chamber, and an electrically ignited primer, wherein the primer is configured to project the projectile during use;
- the cartridge case comprising a second fastening element configured to lock, during use, the ammunition inside the barrel onto the first fastening element, such that the cartridge case sticks out from the barrel and is only partially jacketed by the barrel.

2. The ammunition according to claim 1, wherein the electrically ignited primer comprises a resistive bridge having a low resistance before use and a high resistance after use.

3. The ammunition according to claim 1, further comprising a pyrotechnic charge configured to produce, during use, a kinetic energy of the projectile divided by an impact surface area of less than 100 Joules/$cm^2$.

4. A preloaded barrel for a weapon, comprising:

- a barrel having a first fastening element, wherein the barrel is loaded with an ammunition comprising:
  - a cartridge case housing a projectile and an electrically ignited primer, wherein the primer is configured to project the projectile during use;
  - the cartridge case comprising a second fastening element configured to lock, during use, the ammunition inside the barrel onto the first fastening element;
- wherein the cartridge case sticks out from the barrel and is only partially jacketed by the barrel.

5. The preloaded barrel according to claim 4, wherein the first and second fastening elements are configured to collectively form a bayonet connection.

6. The preloaded barrel according to claim 4, wherein the first fastening element of the barrel is female and the second fastening element of the cartridge case is male.

7. A magazine assembly comprising a plurality of preloaded barrels according to claim 4, each of the preloaded barrels being configured to load and unload the ammunition.

8. The magazine assembly according to claim 7, wherein the magazine assembly comprises five barrels configured to load five pieces of ammunition.

9. A launcher comprising the magazine assembly according to claim 7, wherein the magazine assembly is configured to be removable and can be separated from the weapon.

10. The launcher according to claim 9, wherein the launcher includes a grip comprising at least one hole configured to house, during use, the cartridge case sticking out from the magazine assembly when the magazine assembly is inserted onto the grip.

11. The launcher according to claim 10, wherein parts of the cartridge case situated in the hole when the magazine assembly is inserted on the grip are not held by the hole, a clearance of 0.3 to 5 mm being provided between the cartridge case and the hole.

12. The launcher according to claim 9, wherein the launcher is a less lethal launcher.

13. A barrel for a weapon, the barrel comprising:

a barrel having a first fastening element, wherein the barrel is configured to cooperate with an ammunition comprising:

a cartridge case housing a projectile and an electrically ignited primer, wherein the primer is configured to project the projectile during use, wherein the cartridge case comprises a second fastening element;

wherein the first and second fastening elements collectively form a bayonet connection configured to lock, during use, the ammunition inside the barrel.

14. The barrel of claim 13, wherein the first fastening element of the barrel is female and the second fastening element of the cartridge case is male.

15. The barrel of claim 13, further comprising the ammunition loaded into the barrel to form a preloaded barrel.

16. The preloaded barrel according to claim 15, wherein the cartridge case sticks out from the barrel and is only partially jacketed by the barrel.

17. A magazine assembly comprising a plurality of barrels according to claim 13, each of the barrels being configured to load and unload the ammunition.

18. A launcher comprising the magazine assembly according to claim 17, wherein the magazine assembly is configured to be removable and can be separated from the weapon.

* * * * *